United States Patent [19]

Edgar et al.

[11] 4,227,063

[45] Oct. 7, 1980

[54] MICROWAVE APPARATUS SEAL

[75] Inventors: Richard H. Edgar, Chelmsford; E. Eugene Eves, II, Nabnasset; Charles L. Gilliatt, Andover, all of Mass.

[73] Assignee: Raytheon Company, Lexington, Mass.

[21] Appl. No.: 872,189

[22] Filed: Jan. 25, 1978

[51] Int. Cl.[2] ..... H05B 9/06

[52] U.S. Cl. ..... 219/10.55 A; 219/10.55 F; 219/10.55 D

[58] Field of Search ..... 219/10.55 R, 10.55 F, 219/10.55 A, 10.55 D

[56] References Cited

U.S. PATENT DOCUMENTS

| | | | |
|---|---|---|---|
| 2,868,939 | 1/1959 | Pound | 219/10.55 A |
| 3,048,686 | 8/1962 | Schmidt | 219/10.55 A |
| 3,151,230 | 9/1964 | Britton | 219/10.55 A |
| 3,365,562 | 1/1968 | Jeppson | 219/10.55 A |
| 3,558,840 | 1/1971 | Dunn et al. | 219/10.55 A |
| 3,624,335 | 11/1971 | Densch | 219/10.55 A |
| 3,665,141 | 5/1972 | Schittman et al. | 219/10.55 A |
| 3,674,422 | 7/1972 | Gray . | |
| 3,688,068 | 8/1972 | Johnson | 219/10.55 A |
| 3,749,874 | 7/1973 | Edgar | 219/10.55 A |
| 3,774,003 | 11/1973 | Kaufman et al. | 219/10.55 A |
| 3,974,353 | 8/1976 | Goltsos | 219/10.55 A |
| 4,039,795 | 8/1977 | Lazlo et al. | 219/10.55 A |

OTHER PUBLICATIONS

Matthaei, G. L. et al., Microwave Filters, Impedance Matching Networks and Coupling Structures, McGraw Hill, 1964, pp. 380–400.

Van Koughnett et al., Double Corrugated Chokes for Microwave Heating Systems, Journal of Microwave Power, 8(1), 1973, pp. 101–110.

*Primary Examiner*—Arthur T. Grimley

*Attorney, Agent, or Firm*—Joseph D. Pannone; Milton D. Bartlett; William R. Clark

[57] ABSTRACT

A microwave heating enclosure having apertures for providing continuous access to the processing region with means for substantially preventing microwave energy leakage from said apertures. Said means for substantially preventing leakage comprises an elongated hollow structure at each aperture which forms a seal in combination with moving pallet cars. Said pallet cars are part of a transporting system used to move product through the processing region. Also disclosed is a seal for substantially preventing microwave energy leakage into the region where the pallet car wheels rotate on their axles.

5 Claims, 4 Drawing Figures

MICROWAVE APPARATUS SEAL

BACKGROUND OF THE INVENTION

The processing of materials by means of microwave energy radiated within an enclosure has been wide spread in the home and industry for a number of years. The molecular agitation within the material resulting from its exposure to microwave energy provides frictional heat to cook or dry the material in a relatively short time period as compared to conventional gas or electric heating. The generators most frequently employed in such application are magnetrons and high power vacuum triodes.

The common frequencies of operation allocated by government agencies for microwave heating systems are centered at 915 and 2450 megahertz. The intensity of microwave energy permitted to leak from domestic and/or industrial microwave heating systems is restricted to less than 10 milliwatts per square centimeter. For example, in the United States, the Department of Health Education and Welfare presently requires that the microwave energy leakage from a domestic oven must not exceed one milliwatt per square centimeter in the factory or five milliwatts per square centimeter in the home. The Occupational Safety and Heath Administration requires a microwave energy exposure of less than ten milliwatts per square centimeter. The standard adopted by the International Microwave Power Institute for intensity of microwave radiation leakage from domestic and industrial systems is "less than ten milliwatts per square centimeter".

Systems employing the use of microwave energy for heating or drying must have heretofore prevented the microwave energy from escaping the enclosure where the product is processed. For example, microwave energy leakage has been prevented in a batch system where the product is delievered into the enclosure through a door by closing and sealing the door during operation. However, in many industrial microwave heating applications it is desirable that access apertures in the microwave energy processing region remain open during operation so that a transporting system such as a conveyor belt can continuously move products through said processing region. The prevention of microwave energy leakage through these access apertures presents a serious problem for high volume microwave processing systems.

Panels made from lossy materials have been used to line the inner walls of a hollow structure, or tunnel, which has one end abutting an aperture. The product then passes through the hollow structure, or tunnel, on a conveyorized system and is presented to the microwave processing region. Microwave energy which radiates down the tunnel toward the exterior of the system is absorbed by the lossy material. However, for large apertures, the system efficiency is relatively low because a substantial amount of energy is consumed by the lossy material. Also, if mutually orthogonal dimensions of a cross-section of the tunnel are large relative to a free space wavelength of the microwave energy, the tunnel has to be prohibitively long to be an effective seal.

A means of improving sealing when the mutually orthogonal sealing tunnel dimensions are increased uses a plurality of thin metal flaps hung in the tunnel having lossy walls. As the product passes through, it pushes the flaps aside. However, such flaps are not a sufficiently effective seal when the tunnel cross-sectional mutually orthogonal dimensions are substantially greater then a free space wavelength of the microwave energy or when product pushing aside the flaps is not sufficiently lossy. Also the increased surface area of such enlarged tunnel accounts for additional microwave energy loss from the processing region further reducing the system efficiency.

SUMMARY OF THE INVENTION

The invention discloses a means movable through an elongated hollow structure surrounding an access opening of an enclosure for substantially reflecting microwave energy toward said enclosure. The term microwave is defined to be electromagnetic wave energy having a free space wavelength in the range from one millimeter to one meter. The opening provides continuous access to a microwave processing enclosure so that the system will not be limited by the constraints of batch operation. More specifically the elongated hollow structure has mutually orthogonal cross-sectional interior dimensions greater than the free space wavelength energy. Also, said movable means comprises a plurality of conductive members that pass through the hollow structure and aperture forming microwave seals in combination with the inner walls of said hollow structure. The seals substantially prevent the leakage of microwave energy between the periphery of a conductive member and the inner walls of said hollow structure.

Preferably the conductive members are microwave energy reflectors that are spaced apart and attached to the product transporting system comprising a train of vehicles called pallet cars. The pallet cars are serially connected to form a continuous loop. After product is placed on a car, it passing through the hollow structure and aperture into the enclosure where the product is processed. Then, after exiting through another aperture and hollow structure, the product is removed and means are provided for cycling the car as part of the train back to the loading station where the process is repeated. Although pallet cars are disclosed, any conveying system with spaced conductive members or reflectors would be appropriate. It is preferable that the length of the hollow structure be such that at least two of the conductive members are in it at all times during operation. A conductive member in a hollow structure prevents microwave energy from escaping through the center portion of the hollow structure by reflecting the energy back into the enclosure. Microwave energy is substantially prevented from leaking through the gap between a conductive member and the inner walls of the hollow structure by a seal comprising the peripheral regions of said member and a plurality of conductors approximately one-quarter wavelength long extending inward from the walls of the hollow structure. By providing spaces in the conductors in the peripheral direction and thereby forming a plurality of posts, propagation of microwave energy around the periphery is inhibited so that a wide range of spacings between the ends of the conductors and the peripheral edges of the reflectors can be used. For a comprehensive description of this technique of inhibiting peripheral mode transmission and thereby substantially preventing microwave leakage through the peripheral gap, see U.S. Pat. No. 3,767,884 issued to J. M. Osepchuk on Oct. 23, 1973. The seal could also be formed by affixing said posts to the conductive members instead of the hollow structure.

Also disclosed is a means for sealing the wheels of the vehicles outside said enclosure and high energy field so that the bearings will not arc. More specifically, one-quarter wavelength posts extend inward from the enclosure structure forming seals as described above with said vehicle.

BRIEF DESCRIPTION OF THE DRAWINGS

The foregoing and other objects and advantages will be understood more fully in the following detailed description thereof with reference to the accompanying drawings wherein.

DESCRIPTION OF THE PREFERRED EMBODIMENT

Figures 1, 1A:
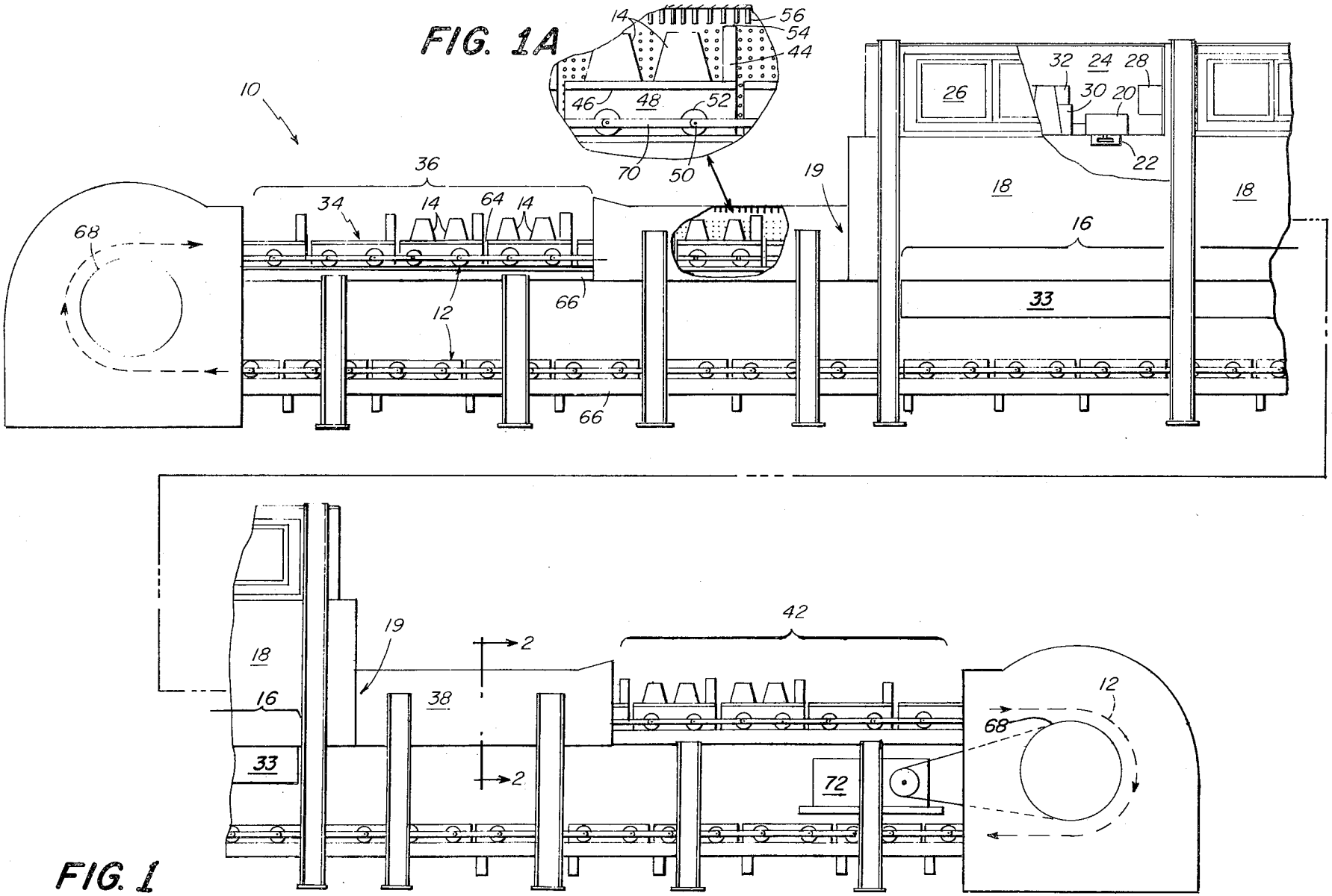
FIG. 1 is a side elevation showing the drying enclosure hollow structures on both ends of it, and the continuous transporting system embodying the invention.
FIG. 1A is an expanded view of fragment of a hollow structure of illustration in FIG. 1.
Figure 2:
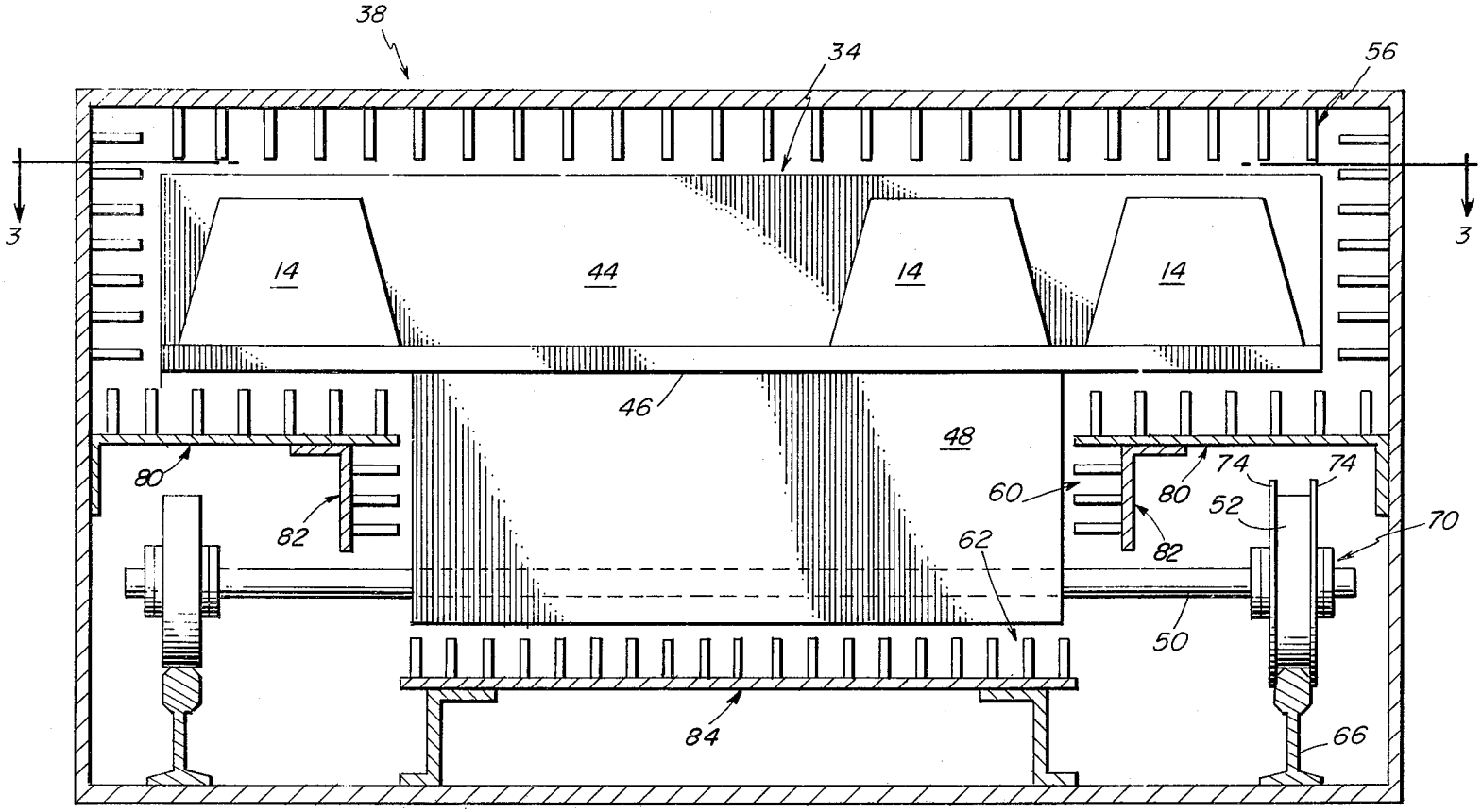
FIG. 2 is a transverse sectional view of the system of FIG. 1 taken along line 2—2 of FIG. 1.
Figure 3:
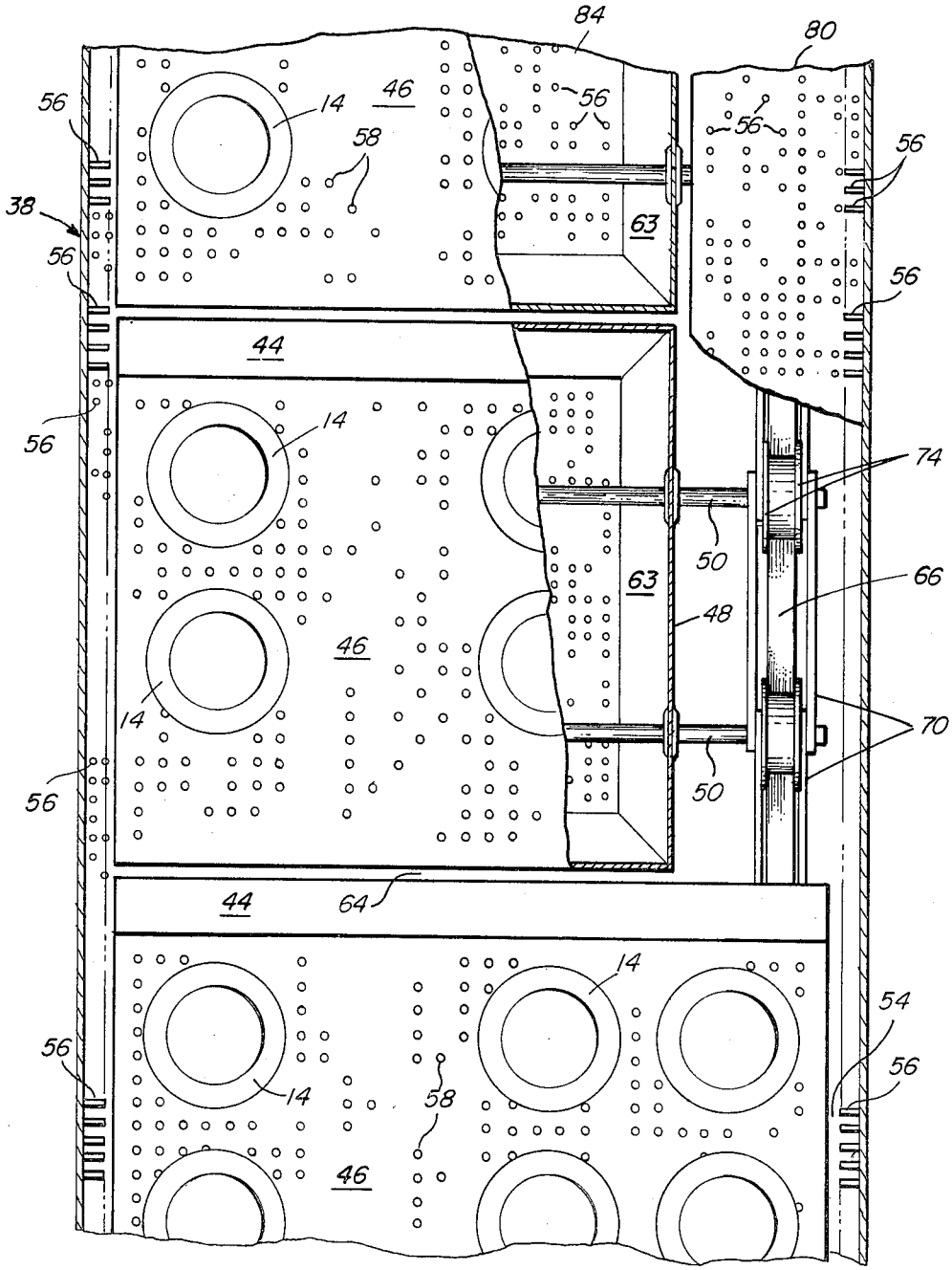
FIG. 3 is a fragmenting horizontal section of one of the hollow structures of FIG. 1 taken down line 3—3 of FIG. 2.

Referring to FIGS. 1-3 of the drawings, a microwave drying apparatus 10 has a continuous loop transporting system 12 to move the product 14 through the enclosure 16. The enclosure 16 is a substantially parallelepiped structure which is formed by joining together a plurality of sections 18. Each end of the enclosure 16 has an aperture 19 which provides continuous access to the enclosure 16. Microwave energy is introduced into the enclosure 16 by a plurality of magnetrons 20, each of which is coupled directly into a radiating structure 22 of any desired type mounted on the upper wall of the enclosure 16. In the preferred embodiment, the magnetrons 20 operate at a frequency of approximately 2450 MHz and the interior dimensions of the enclosure 16 are substantially greater than a free space wavelength of said energy.

Air is drawn through filters 26 into a cavity 24 above the drying enclosure 16. The air passes over the magnetron power supplies 28 and the magnetrons 20 to cool them and in the process, the air becomes heated. The hot air in cavity 24 is then drawn through a duct 30 by a blower 32 and forced down into the drying enclosure 16 to scavenge vaports emanating from product 14. The hot air is then sucked through an exhaust duct 33 below the enclosure 16 by an exhaust fan (not shown) to remove water vapor and other gases from the drying enclosure 16. The floor of the drying enclosure is a perforated conductive material to permit the passage of air but prevents the propagation of microwave energy. The above-described process increases the vapor pressure gradient between the interior of the enclosure 16 and the surface of the product 14 to permit more efficient and rapid drying of the product 14. For example, an application of the invention is drying foundry cores 14. The cores are placed on pallet cars 34 at the loading region 36. The cars 34 pass through the entrance tunnel 38, through the drying enclosure 16 where the cores 14 are dried by microwave energy and hot air, and then through the exit tunnel 38. At the unloading region 42, the cores 14 are removed from the cars 34. A means, not described in detail herein, is provided for cycling the train of cars 34 back around to the loading region 36 where the process is repeated.

A pallet car 34 is comprised of a vertical member referred to hereinafter as septum 44, a tray 46 on which the foundry cores 14 are placed, a rectangular shaped base structure 48 on which the tray 46 is mounted and axle/wheel assemblies 50 and 52, respectively.

The septum 44 is fabricated from a conductive material that will reflect rather than absorb or be transparent to microwave energy. In the preferred embodiment, the material is aluminum. The septum 44 performs two functions. First, it is a reflective shield that prevents microwave energy from propagating from the enclosure down the center of the tunnel and escaping to the exterior. For this purpose, it is preferable that the dimensions of a septum 44 be such that it occupies a substantial portion of the cross-sectional area of the tunnel 38 as viewed from the drying enclosure 16. However, because of mechanical constraints, there must be some gap 54 between the outer periphery of a moving septum 44 and the inner walls of the tunnel 38; therein arises the second function of a septum. It serves as an inner element for a seal that substantially prevents microwave energy leakage between the septum 44 and the tunnel 38 walls.

Guide stubs in microwave waveguide have been documented in the art for many years. When the depth (that is, effective electrical length) of the stub is one-quarter of the guide wavelength for a propagating $TE_{mo}$ mode, the stub is equivalent to a series open circuit for that mode. The extremely high impedance causes the energy in that mode to reflect back toward its source. The cylindrical posts 56 as shown in FIG. 2 and FIG. 3 present the same very high impedance to microwave energy attempting to propagate between the septum 44 and the tunnel 38 walls. Additionally, this arrangement offers a major advantage. In general, seals require a separate guide stub for each propagating mode. However, the "waffle-iron" type structure as shown in FIG. 2 and FIG. 3 with a depth of fifty-one posts 56 in each row through the tunnel is essentially isotropic and has the same characteristics, at a given frequency, for TEM waves traveling through in any direction. Because any $TE_{mo}$ mode can be resolved into TEM waves traveling in different directions through the seal, the properties of the seal are a function of frequency only and not mode dependent. To simplify fabrication of the tunnel 38, cylindrical posts 56 were used in the preferred embodiment; the same sealing characteristics could be attained, however, using posts 56 of a different shape such as square. The posts 56 are approximately one-quarter of the free space wavelength long or 1.025" and they have a diameter of approximately 0.375". For most applications, the gap 54 should be less than 0.2 wavelengths; for the preferred embodiment, it was designed to be 0.25" which is well within 0.2 wavelengths which would be approximately 1.0" at the operational frequency. The center of each post 56 is 1.125" from the centers of the closest adjacent posts. There are 48 rows of posts across the top of each tunnel; for illustrative clarity, only half that many are shown in FIG. 2. As illustrated in FIG. 2, there are 7 rows of posts on the top of each side and seven rows extending from horizontal panels 80 which are adjacent and parallel to the bottom of the septum 44 extension from the base 48. There are also three rows extending from vertical panels 82 which are adjacent and parallel to the sides of the base 48. There are 34 rows of posts entending from a panel 84 adjacent and parallel to the bottom of the base 48; for clarity these are illustratively shown as 19 posts in FIG. 2. In the heating enclosure 16, the center portion of this bottom panel 84 is deleted and there are only 3 rows of posts on each side of the bottom of the base 48. Each one of the above-described rows contains fifty-one posts 56 through the length of the tunnel 38.

Further, the spaces between the posts in the peripheral direction inhibit peripheral mode transmission as discussed in U.S. Pat. No. 3,767,884 which issued to J. M. Ospechuk on Oct. 23, 1973. As described therein, said inhibiting restricts propagation down the tunnel in the gap between the periphery of a conductive member and the inner wall of the tunnel to the extent that substantially all microwave energy in the tunnel is reflected back toward the enclosure.

The moving septum 44 is the inner element of the post/septum seal as it can be compared to the opposite wall of a wave guide with a guide stub. The thickness of the septum 44 is important because it determines the number of posts 56 in each row that are included in the seal at any given time as the septum 44 moves through the tunnel 38. For the septum 44 to be effective, it should span at least two adjacent posts 56 in each row at all times so as to form a seal with the one-quarter wavelength space between them. This means that the septum 44 thickness should be at least twice the distance between two posts 56 or 2.5". In the preferred embodiment the thickness is 3.0". As this thickness is increased bringing more and more posts 56 into the instantaneous seal, the effectiveness of the seal is increased but the area on the tray 46 for the product 14 is decreased. As the length of a pallet car 34 is sightly under 30" and the length of the tunnel 38 is 61", there will be at least two septums 44 in the tunnel 38 at all times to further suppress the leakage of microwave energy.

The tray 46 is constructed of a reinforced conductive material with a plurality of 0.5" diameter holes 58. These holes 58 permit the hot air carrying water moisture and vapors to pass from the drying enclosure 16 at an exhaust duct 33 below. The holes 58 are small enough so that microwave energy will not propagate through them.

The base structure 48 is fabricated of conductive material that forms a rectangle. The base serves two functions. First, it provides a structure onto which the non-rotating axles 50 mount and, second, it acts as the inner element for seals at the sides 60 and the bottom 62 as shown in FIG. 2. These seals are comprised of cylindrical posts 56 that are identical to the ones described above. The inner element of the bottom seal 62 is a 3" conductive panel 63 that extends inward horizontally from the periphery of the bottom of the base 48. The purpose of the seals at 60 and 62 is to protect the wheels from microwave energy that is able to escape to the bottom region through the space 64 between the pallet cars 34.

It is a common phenomenon in high microwave energy fields that conductive parts moving in close proximity to one another tend to arc. In order to prevent this problem, the axles 50 which are in the microwave energy field do not rotate with respect to the base 48. Rather, it is the wheels 52 that contain ball bearings (not shown) and rotate on the axles 50 and the wheels 52 are located outside the high energy field. Rails 66 are provided on both sides of the entrance tunnel 38 as shown in FIG. 2 and they continue through the drying enclosure 16 and the exit tunnel 38 on the other end of the enclosure 16 as illustrated in FIG. 1. Rails 66 are also provided underneath the above-mentioned structures to carry the pallet cars 34 back to the loading region 36. A means, shown as 68 but not described in detail herein, is provided for rotating the pallet cars 34 around the axes and circulating them in a continuous loop. Each axle is attached to the axle 50 in front and behind it by two metal struts 70 which join the pallel cars 34 into a chain-type mechanism that can be driven by one motor 72 at one point.

Each of the right-hand wheels 52 has a flange 74 on the inside and outside. The purpose of these flanges 74 is to guide the right wheels 52 along the right rails 66. The horizontal alignment of a pallet car 34 is calibrated by adjusting the position of the right wheels 52 on the axles 50. This horizontal alignment is critical to maintain approximately equal gaps 54 on both sides of the septum 44 and to prevent damage to the system caused by the septum 44 and the base 48 striking the cylindrical posts 56. There are not serious expansion or contraction problems as both the cars 34 and the tunnels 38 are fabricated from the same material, namely aluminum, and the maximum temperature reached in the tunnels does not exceed 150° F.

Although the application of this invention is a core drying apparatus, the reading of this disclosure by those skilled in the art will lead to various modifications and alteration within and without the application without departing from the spirit and scope of the invention as defined in the appended claims. It is intended, therefore, that the embodiment shown and described herein be considered as exemplary only and that the scope of the invention be limited only by the appended claims.

What is claimed is:

1. In combination:

A conductive enclosure energized with microwave energy and having at least one access aperture;

an elongated hollow structure extending outward from said aperture;

a plurality of microwave energy reflectors spaced apart in and being movable through said hollow structure and having mutually orthogonal dimensions greater than the free space wavelength of said energy;

microwave energy seals each comprising peripheral regions of a reflector and regions of the walls of said hollow structure;

said seals inhibiting the transmission of said energy in the gap between said wall regions and said peripheral regions in a direction substantially perpendicular to the length of said hollow structure; and means for transporting a product comprising a train of vehicles connected in a loop.

2. The combination in accordance with claim 1 wherein said seal comprises a plurality of conductive posts approximately one-quarter wavelength long extending inward from the walls of said hollow structure.

3. In combination:

a conductive enclosure energized with microwave energy and having a plurality of apertures;

a hollow structure at each of said apertures having mutually orthogonal cross-sectional interior dimensions greater than a free space wavelength of said energy;

a train of vehicles carrying products through said hollow structures in said enclosure;

each of said vehicles having a conductive member forming a seal with wall portions of said hollow structure as said member passes therethrough; and said seal inhibiting the transmission of said energy in the gap between said wall portions and said member in a direction substantially perpendicular to the length of said hollow structure.

4. The combinaton in accordance with claim 3 wherein said seal comprises a plurality of conductive posts approximately one-quarter wavelength long extending inward from said wall portions of said hollow structure.

5. In combination:

a conductive enclosure energized with microwave energy having a plurality of apertures;

means for moving the product through said enclosure said means comprising a plurality of vehicles having wheels that rotate on axles, said axles extending through slots in said enclosure so that said wheels are positioned outside said enclosure; and means for preventing the propagation of said energy through said slots, said preventing means comprising a plurality of posts one-quarter wavelength long extending inward from the enclosure structure forming seals with said vehicles.

* * * * *

UNITED STATES PATENT OFFICE

CERTIFICATE OF CORRECTION

Patent No. 4,227,063 Dated October 7, 1980

Inventor(s) Richard H. Edgar, Eugene Eves, II & L. Gilliatt

It is certified that error appears in the above-identified patent and that said Letters Patent are hereby corrected as shown below:

Column 2, line 36 change "passing to --passes--;

Column 2, line 2 change "then" to --than--;

Column 5, line 28 change "2.5" to --2.25--;

Column 5, line 40 change "at" to --to--.

Signed and Sealed this

*Twenty-third* Day of *June 1981*

[SEAL]

*Attest:*

RENE D. TEGTMEYER

*Attesting Officer* *Acting Commissioner of Patents and Trademarks*